United States Patent [19]

Corazza

[11] Patent Number: 4,501,202

[45] Date of Patent: Feb. 26, 1985

[54] BODY SHOP WORKTABLE

[76] Inventor: Herman Corazza, 1330 Kimberly Ave., Rock Springs, Wyo. 82901

[21] Appl. No.: 437,040

[22] Filed: Oct. 27, 1982

[51] Int. Cl.[3] ..... B25H 1/10

[52] U.S. Cl. ..... 108/50; 108/28; 144/286 R; 269/296

[58] Field of Search ..... 108/50, 55.1, 55.3, 108/24, 28, 31; 144/286 R, 286 A, 287, 308; 312/280, 196; 269/296

[56] References Cited

U.S. PATENT DOCUMENTS

| | | | |
|---|---|---|---|
| 1,736,172 | 11/1929 | Raymond | 108/55.1 |
| 2,431,589 | 11/1947 | Shuler, Jr. | 108/55.3 X |
| 2,908,403 | 10/1959 | Browder, Jr. et al. | 269/296 X |
| 2,923,416 | 2/1960 | Vogel | 108/28 |
| 3,006,108 | 10/1961 | Coudit | 108/28 |
| 3,071,269 | 1/1963 | Moulds, Jr. | 108/55.3 X |
| 3,364,882 | 1/1968 | Merrick | 108/50 X |

FOREIGN PATENT DOCUMENTS

| | | | |
|---|---|---|---|
| 9202 | of 1913 | United Kingdom | 108/28 |

*Primary Examiner*—William E. Lyddane
*Assistant Examiner*—Peter R. Brown
*Attorney, Agent, or Firm*—Terry M. Crellin

[57] ABSTRACT

A worktable for use in automobile body shops. The table has removable sideboards which are adapted to extend upwardly from the side edge of the table, with the sideboards being positioned substantially coplanar with a plane adjacent to the side of the table and substantially normal to the top surface of the table. The sideboards are used to support various automobile body parts, such as fenders and grilles, in an elevated easily accessible and workable position. The sideboards are removable so that the top of the table can be used to support other parts of the automobile body, such as the hood, trunk deck, window glass, etc. A pair of cushion bolsters can be provided for supporting windshields and bumpers to prevent scratching or otherwise damaging the surface of such articles. Dispensers can be also be included in the work-table for dispensing sanding discs and masking paper.

10 Claims, 4 Drawing Figures

BODY SHOP WORKTABLE

BACKGROUND OF THE INVENTION

1. Field

The present invention pertains in general to worktables and in particular to worktables designed for use in automobile body shops.

2. State of the Art

Worktables and benches of various designs and uses are widely known and used. A table or bench for use in repairing doors and other irregular shaped portions of an automobile is disclosed in U.S. Pat. No. 2,469,151. The table of that patent, however, is not well adapted for holding such parts of an automobile body as the fenders and grilles in an elevated position in which the parts are easily accessible from essentially all sides such that the parts can be readily worked on and in particular painted with realative ease. A plumber's table is shown in U.S. Pat. No. 2,883,184, and a paperhanger's table is shown in U.S. Pat. No. 1,462,449. Neither of the latter two tables, however, is at all adapted for use in an automobile body repair shop.

OBJECTIVES

A principal objective of the present invention is to provide a worktable which is adapted to various uses in an automobile body repair shop. A particular objective is to provide a worktable having removable sideboards which are adapted to hold fenders, grilles, etc. of an automobile body in an elevated, easily accessible and workable position. It is a further objective of the invention to provide a table which can be used as a conventional worktable as well as for various specialized uses in an automobile body repair shop.

SUMMARY OF THE INVENTION

The above objectives are achieved in accordance with the present invention by providing a worktable comprising a substantially horizontally disposed top surface. At least a pair of substantially planar sideboard members are adapted to be removably attached to a mutually corresponding side of the top of the table. The sideboard members are adapted to extend upwardly from the side edge of the top surface of the table, with the sideboard members being positioned substantially coplanar with a plane adjacent to the side of the top surface of the table and substantially normal to the top surface.

The sideboard members, when attached to a mutually correspondind side of the worktable, are particularly adapted to have an automobile fender, grille or other body member suspended from the top edges of the sideboard members and to hang downwardly along the sideboard members and the corresponding side of the worktable. The fender, grille or other body member is, thus, suspended in a slightly elevated position along the side of the worktable. In such a suspended position, the article is readily accessible from almost all sides of the article for various work operations to be performed on the article. The article is in an ideal position for painting. The outside surface of the article is entirely exposed, and the article is positioned at an ideal elevation for painting. Sideboard members can be attached to opposite sides of the table so that two items or articles can be worked on at the same general time. The table is still accessible for tools and other items being used during the work being performed on the articles suspended from the sideboard members.

Means are provided for releasably securing the sideboard members to the worktable so that the sideboard members can quickly and easily be mounted and dismounted from the table. When the sideboard members are dismounted from the table, the table can advantageously be used as a conventional worktable. Flat articles such as hoods and trunk decks can be positioned on the table when the sideboard members have been removed. Bolsters can also be provided to be positioned on the top surface of the table. The bolsters are adapted to support automobile glass, such as windshields as the glass is being prepared for installation in the automobile. The bolsters are cushioned so as to support the glass above the table top without scratching the glass. The bolsters can also be used in supporting other items which are to be protected from scratching such as polished chrome articles including bumpers and trim items.

Advantageously, a system can be provided with the table for dispensing sanding discs and elongate strips of masking paper. The dispensing system may comprise means at one end of the table for dispensing the sanding disc and additional means at the opposite end of the table for dispensing the masking paper.

Additional objects and features of the invention will become apparent from the following detailed description taken together with the drawings.

THE DRAWINGS

A preferred embodiment of the invention representing the best mode presently contemplated of carrying out the invention is illustrated in the accompanying drawings, in which.

DETAILED DESCRIPTION OF THE ILLUSTRATED EMBODIMENT

Figure 1:
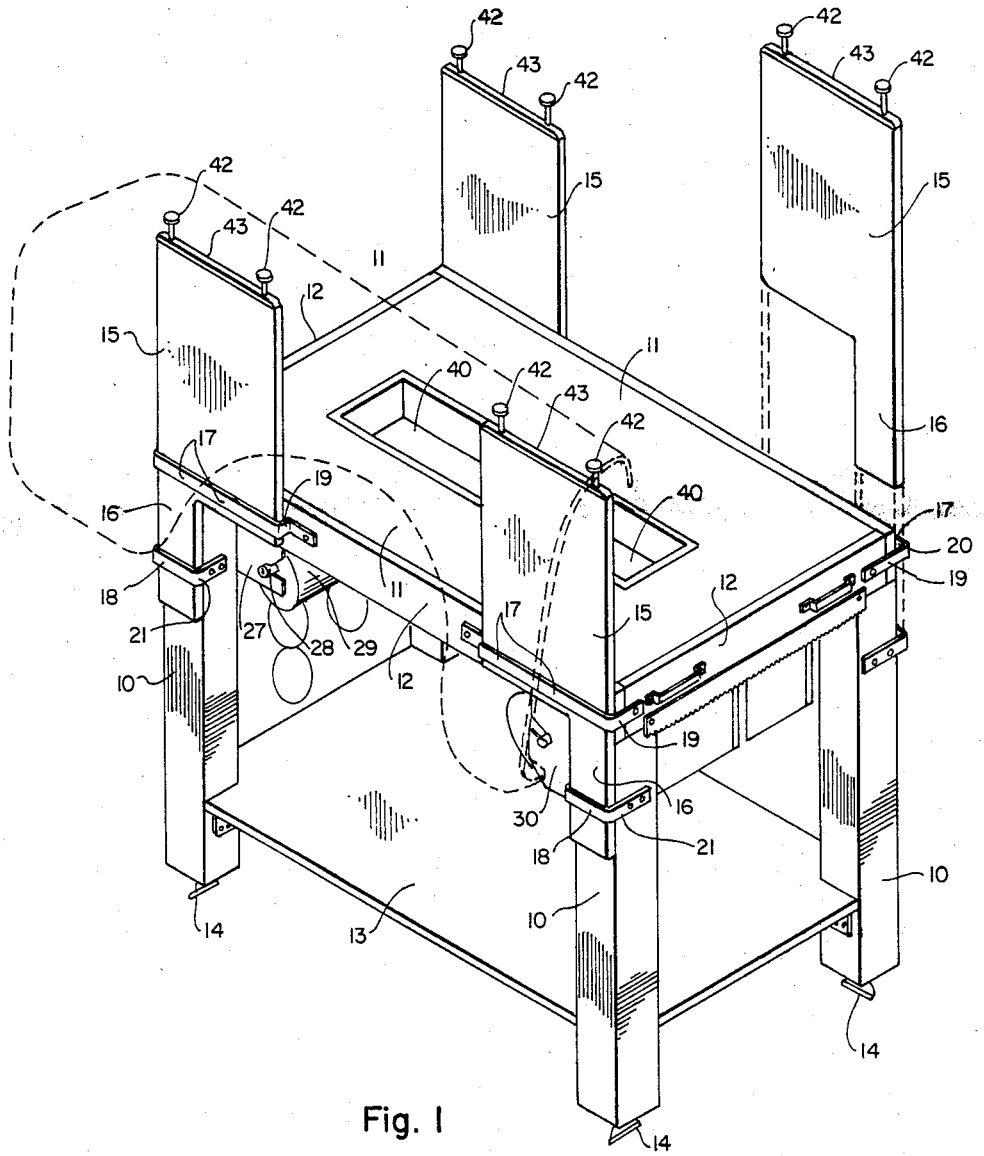
FIG. 1 is a pictorial view of the present invention showing one of the sideboards in exploded perspective and with an automobile fender shown suspended in phantom along one side of the table.

In the illustrated embodiment of the invention, the worktable comprises four legs 10 which support the horizontally disposed top 11. The legs 10 are preferably made of wooden posts, with a finished 4 by 4 post being particularly preferred. The top 11 can be made of any flat material made of metal, plastic laminate, reinforced plastic or wood. In the preferred embodiment, the top 11 is made of plywood having a thickness of from about ½ inch to 1 inch or greater. A side flange 12 is provided around the perimeter of the top 11. The side flange 12 provides strength for the table as well as a support for other components as will be described hereinafter. The side flange 12 preferably comprises wooden boards cut to fit around the top 11. The boards from which the side flange 12 is made are advantageously finished 1 by 4 boards.

Preferably, the top 11 of the table is generally rectangular, with the long sides being substantially greater in length than the shorter sides and with the four legs 10 extending downwardly from the four corners of the table. Generally the longer sides of the table will be from about 3 to no more than 5 or 6 feet in length, with the shorter sides being from about 2 to no greater than 3 feet in length. A particularly preferred size for the top 11 of the table is about 4 feet by about 2½ or 3 feet. The height of the legs 10 can be from about 2½ to 4 feet. A storage shelf 13 can be provided below the top 11. As illustrated, the shelf 13 has a dimension about the same as the top 11. The shelf 13 is preferably spaced about ¾ foot to about 1½ feet from the bottom of the legs 10. The shelf 13 provides strength and rigidity to the table in addition to providing storage.

Casters 14 can be provided on the bottom of the legs 10 to allow the table to be easily moved from one place to another in the automobile body shop. Hand grips 23 can also be provided at the end side faces of the table adjacent to the top surface 11 for use in moving the table. The hand grips 23 are conveniently attached to the side flange 12 at the ends of the table as illustrated.

At least one pair of substantially planar, sideboard members 15 are provided. The sideboard members 15 are adapted to be removably attached to a mutually corresponding side of the top surface 11 so that the sideboard members 15 extend upwardly from the side edge of the top surface 11. When attached to the table, the sideboard members 14 are positioned substantially coplanar with a plane which is adjacent to the side of the top surface 11 and substantially normal to the top surface 11. The sideboard members 15 are advantageously made of plywood or other substantially broad, flat boards. Generally, the sideboard members 15 will have dimensions such as to extend upwardly from the top 11 of the table by about 6 to 24 inches. The width of the sideboard members 15 along the side edge of the table can be from about 6 inches to 15 inches. The thickness of the sideboard members can be from about ¼ inch to 1 inch, preferably about ⅜ inch to ¾ inch.

Means are provided for releasably securing the planar sideboard members 15 to the worktable at the respective sides of the top surface 11. As illustrated four sets of attachment means are provided, with each set being positioned adjacent to a corresponding corner of the table, so that the respective members 15 can be secured to the table adjacent to the corners thereof. The attachment means can be used to removably attach a pair of sideboard members 15 to either of the opposite, longitudinal sides of the top 11 of the table. As illustrated, two pair of sideboard members 15 can be attached to the table simultaneously if desired. The attachment means are positioned so that the sideboard members 15 can be quickly secured to the table adjacent to the corners of the table and with the sideboard members 15 being positioned substantially coplanar with the planes adjacent to the longitudinal sides of the table.

In the illustrated, preferred embodiment, each of the planar sideboard members 15 has an extension 16 projecting from the bottom and one side of the otherwise substantially rectangular, sideboard member 15. The extension 16 is a substantially flat, elongate section whose width is no more than about ⅓ of the corresponding width of the rectangular sideboard member 15 (the width of the sideboard member 15 as mentioned above is its broad dimension which lies along the top edge of the table when the sideboard member is secured to the table). The means for releasably securing such planar side members 15 to the table as illustrated comprises four pair of band-like attachment members, with one pair of attachment members being located at each of the respective corners of the worktable. Each pair of attachment members includes an upper bracket 17 and a lower bracket 18. Each of the upper brackets 17 of the four pair of attachment members is attached to a mutually respective side of the table adjacent to the top surface 11 of the table. Each of the lower brackets 18 is attached to a mutually corresponding leg of the table, with the lower brackets being spaced from the respective upper brackets a distance less than the longitudinal length of the flat, elongate extensions 16 which project from the bottom sides of the rectangular sideboard members 15.

The upper brackets 17 each comprise an elongate, rigid band which is spaced from the respective side of the table, with the rigid band having inwardly projecting leg members 19 at the opposite ends thereof. Means are provided for attaching the inwardly projecting ends of the respective leg members 19 of the upper brackets 17 to the mutually respective sides of the table, to form respective, elongate spaces 20 between the upper brackets 17 and the respective sides of the table. In the embodiment of the invention as illustrated, one of the inwardly projecting ends of the respective leg members 19 for each of the upper brackets 17 is positioned so as to be adjacent to the end of the table and is firmly attached to the side flange 12 at the ends of the table. The inwardly extending end of the other mutually respective leg members 19 is bent back so as to abut the flange 12 at the side of the table. The bent back ends are firmly attached to the side flange 12 at the respective longitudinal sides of the table. Each of the elongate spaces 20 between the upper brackets 17 and the respective sides of the table is adapted to receive in snug, sliding engagement therewith the bottom of a respective, rectangular sideboard member 15.

The lower brackets 18 comprise elongate rigid straps which are spaced from the sides of the respective legs 10 of the table. The straps have inwardly projecting leg members 21 at the opposite ends thereof. Means are provided for attaching the inwardly projecting ends of the respective leg members 21 of the lower brackets 18 to the mutually respective sides of the legs 10, to form respective, elongate spaces 22 between the lower brackets 18 and the respective sides of the legs 10. In the embodiment of the invention as illustrated, the inwardly projecting ends of the respective leg members 21 for each of the lower brackets 18 are adapted to be positioned so as to lie adjacent to the adjacent, respective sides of the legs 10, and the leg members 21 are firmly attached to the legs 10. The straps form respective elongate openings 22 between the lower brackets 18 and the respective sides of the legs 10 of the table. Each of the elongate openings 22 is adapted to receive in snug, sliding engagement therewith the free end portion of a respective, flat, elongate extension 16 of a sideboard member 15.

The sideboard members 15 are quickly and easily attached to the table by simply sliding a respective extension 16 of the sideboard members 15 through the upper bracket 17 and engaging the respective extensions 16 in the lower brackets 18 as the sideboard members 15 are lowered through the upper brackets 17. The lower ends of the main rectangular body portions of the sideboard members 15 are adapted to engage the upper brackets 17 as the sideboard members 15 are lowered to their proper position. Various means can be used to limit the movement of the sideboard members 15 through the upper and lower brackets 17 and 18 as the sideboard members 15 attach their proper position extending upwardly from the side edge of the top 11 of the table. Stops (not shown in the drawings) can be provided on either the sides of the table, on the legs 10, or on the sideboard members 15 themselves to hold the sideboard members 15 in the proper position. If the stops are provided on the side of the table or on the legs 10, the stops would be adapted to abut the lower end of the main body portion of the sideboard members 15 or the lower end of the extensions 16 of the sideboard members 15, respectively.

Figure 4:
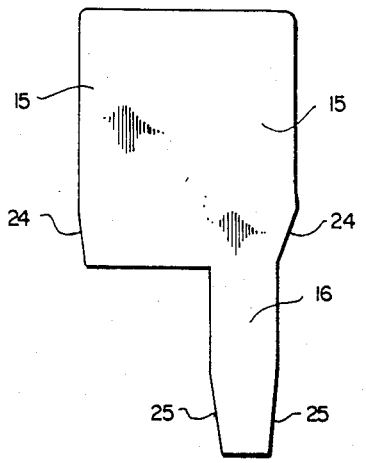
FIG. 4 is an elevation of one of the sideboard members of the table of FIG. 1.

In place of stops, the sideboard members 15 can be designed to cooperate with the brackets 17 and 18 in limiting the downward movement of the sideboard members 15 and achieving proper positioning of the sideboard members with respect to the sides of the table. As shown somewhat exaggerated in FIG. 4, the bottom sides of the rectangular sideboard members 15 are provided with a slight taper 24. The taper 24 slants slightly outwardly from the bottom sides of the sideboard members 15 such that when the sideboard members 15 are in their position engaging the upper brackets 17 so as to extend upwardly from the sides of the table, the tapers 24 make a secure frictional engagement with the leg portions 19 of the upper brackets 17 to limit the downward movement of the sideboard members 15 and hold the sideboard members 15 securely in position at the sides of the table. In addition, similar means can be provided for frictionally engaging the extensions 16 of the sideboard members 15 with their respective lower brackets. Again, as shown somewhat exaggerated in FIG. 4, the sides 25 of the extensions 16 are provided with a taper which slants slightly outwardly from the bottom or free ends of the extensions 16. When the sideboard members 15 are in their position extending upwardly from the sides of the table, the tapered portions of the flat, elongate extensions 16 make secure, frictional engagement with the leg members 21 of the lower brackets 18.

As illustrated, the table is preferably provided with a system for dispensing elongate strips of masking paper and a system for dispensing sanding discs. The systems for dispensing the masking paper and the sanding discs are advantageously located at the opposite longitudinal ends of the table. The system for dispensing the sanding discs may simply comprise support plates 27 which are mounted adjacent to the inside face of the legs 10 at one end of the table. Notches are cut out in the plates 27 for receiving a section of pipe, rod, or bar 28. The pipe, rod or bar 28 extends across the table below the top 11 of the table and preferably just below the side flanges 12 of the table. Rolls of sanding discs 29 are mounted on the rod or bar 28 whereupon individual sanding discs can readily be withdrawn from the roll thereof.

Figure 3:
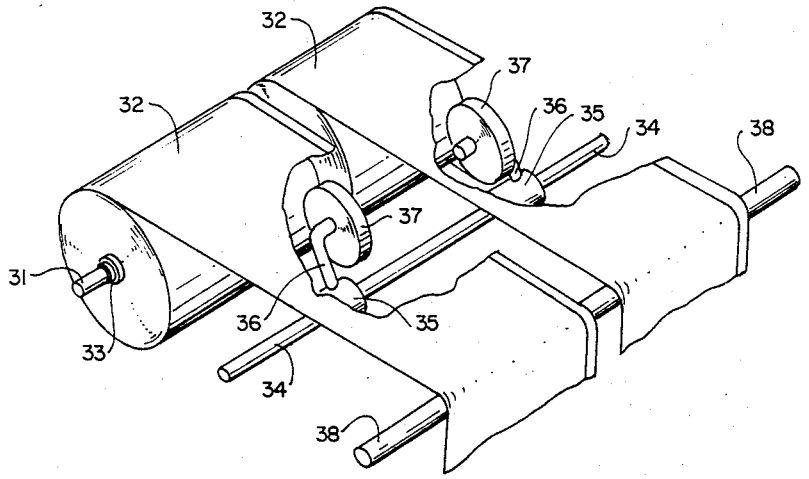
FIG. 3 is a pictorial view of a system for dispensing masking paper, with the dispensing system being shown removed from the table for purposes of illustration.

The system for dispensing the strips of masking tape is located adjacent to one of the longitudinal sides of the table, being the opposite side of the table to that at which the sanding disk dispenser is located in those instances wherein systems are provided for dispensing both sanding discs and masking paper. The system for dispensing the masking paper, as illustrated, comprises support plates 30 which are mounted adjacent to the inside face of the legs 10 at the end of the table. Notches are cut out in the plates 30 for receiving a shaft 31 which can be a section of rod, bar, or pipe. The shaft 31 extends across the table below the top 11 of the table and preferably just below the side flange 12 of the table. Rolls of masking paper 32 are mounted on the shaft 31. As shown in FIG. 3, two or more rolls of masking paper of varying widths can be mounted on the shaft 31. Preferably, means for applying masking tape to one edge of the strips of masking paper is provided, and to accommodate the alignment of the masking tape and masking paper, means are provided for selectively positioning the rolls 32 of masking paper on the shaft 31 so that the rolls 32 can not move from side to side on the shaft 31 as masking paper is withdrawn therefrom. The latter means may simply comprise hubs 33 which slide along the shaft 31 and are adapted to engage the opposite respective ends of a respective roll of masking paper. Set screws are advantageously provided in the hubs 33 to releasably secure them to the shaft 31 to prevent unwanted movement of the rolls 32 of masking paper along the shaft 31.

One means for applying masking tape along the side edges of the strips of masking paper is shown in FIG. 3. A second shaft 34 extends between the plates 30 generally parallel to the shaft 31. The second shaft 34 is further located generally between the first shaft 31 and the respective end of the table. The second shaft 34 may be located somewhat lower on the plates 30 than the first shaft 31. Two or more sliding support hubs 35 are positioned on the second shaft 34. Mounting arms 36 extend from the hubs 35, and are adapted to have rolls 37 of masking tape mounted at their respective free ends. As shown, the mounting arms 36 have the free end portions bent at a right angle to the extending arm portions, and the rolls of masking tape are received on the bent free end portions.

Figure 2:
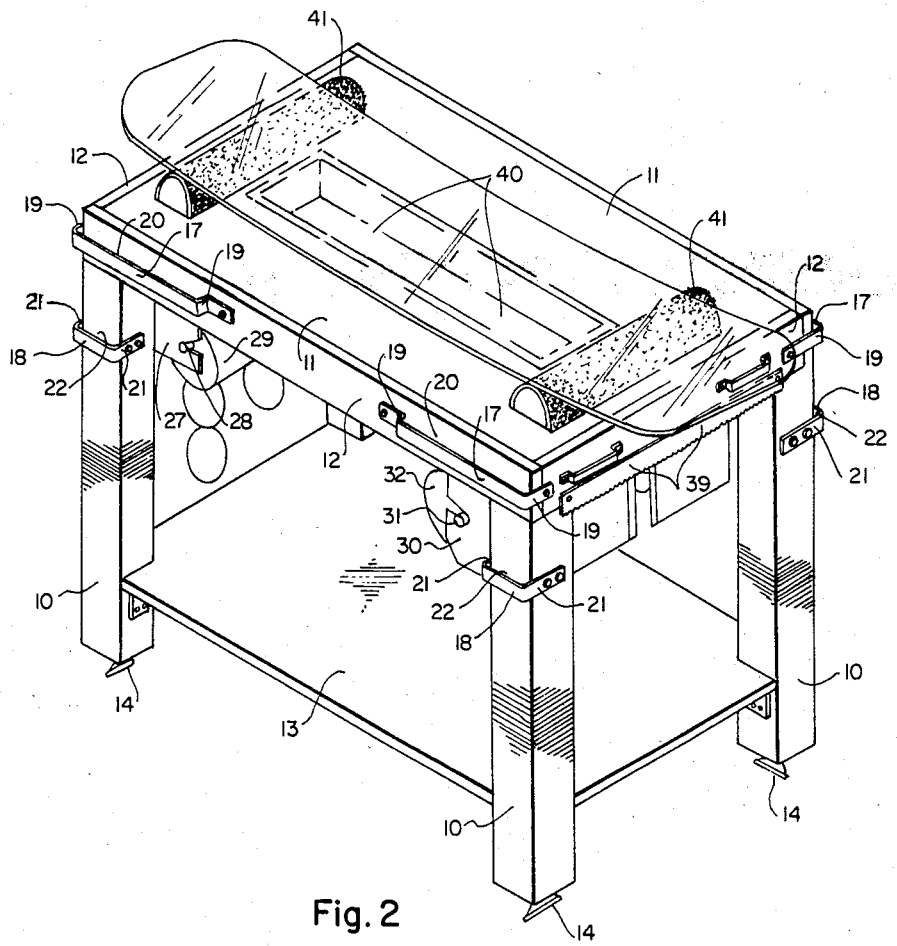
FIG. 2 is a pictorial view of the worktable of FIG. 1 with the sideboards removed and with two bolsters being used on top of the table to support an automobile windshield.

Strips of masking tape are withdrawn from the bottom of the rolls 37 of masking tape and applied to the mutually respective edges of the bottoms of the rolls 32 of masking paper. The masking tape is applied so that approximately half of its width is applied to the edge of the masking paper with the other half of its width extending from the edge of the paper. The masking paper is withdrawn from the top of the rolls 32 forwardly over a third shaft 38 which is located adjacent to the end of the table. The free ends of the masking paper, having masking tape applied along one edge thereof, hangs freely from the third shaft 38 for ready access. A cutting bar 39, as shown in FIGS. 1 and 2 can be provided extending along the bottom edge of the side flange 12 at the end of the table. The cutting bar 39 is conveniently used to sever withdrawn strips of masking paper from the rolls 32 of masking paper. To maintain proper positioning of the masking tape along the edges of the masking paper as the paper is withdrawn from the respective rolls 32 of masking paper, the sliding support hubs 35 are provided with means for adjustably securing them to the shaft 34. Advantageously, the hubs 35 have set screws which can be tightened against the shaft 34 for adjusting the position of the hubs 35 along the shaft 34.

The worktable can also have a longitudinal depression 40 in the top 11 of the table for receiving tools which are used in conjunction with the work being performed. Advantageously a longitudinal, generally rectangular opening is provided in the top 11 of the table, and a removable sheet metal tray is adapted to fit down within the opening. The sheet metal tray, containing all the tools contained therein can then be moved to and from the table as desired.

A set of cushion bolsters 41 can be further provided in combination with the table. The bolsters 41 are adapted to be placed on the top 11 of the table and to have supported thereon automobile glass pieces, bumpers and other items which must be protected from being scratched as they are being prepared for installation on an automobile. The cushion bolsters 41 each preferably comprises a generally cylindrically-shaped block of material, such as wood or plastic, which has had a chord along the length thereof removed to produce a longitudinal flat surface along the length of the block. The flat surface is readily provided by cutting a piece longitudinally from the block. If the cut is made through the center of the block, both pieces which are produced can be used in making the respective bolsters 41. Generally, however, the cut will be made on one side or the other of the center of the block, and only the larger of the resulting pieces is used in making a bolster 41. A cushion material, such as a piece of carpet or foam rubber is applied to the cylindrical surface of the block to form the resulting bolster 41.

As illustrated, metal pins or pegs 42 can be provided extending upwardly from the upwardly free ends of the planar sideboard members 15. A metal bar 43 is preferably securely attached along the upper free ends of the planar sideboard members 15. Threaded openings are then provided in the metal bars 43, with threaded pins or bolts being received in the threaded openings. The threaded pins or bolts are adjustable as to the height they extend from the metal bar 43 and can be removed completely if desired. The protruding ends of the pins or pegs 42 provided means for hooking onto various portions of an item to be suspended from the sideboard members 15. Further, the threaded pins or bolts allow for securely attaching an item to the top of the sideboard members 15.

Although a preferred embodiment of the worktable of this invention has been illustrated and described, it is to be understood that the present disclosure is made by way of example and that various other embodiments are possible without departing from the subject matter coming within the scope of the following claims, which subject matter is regarded as the invention.

I claim:

1. A worktable for use in repairing automobile bodies, said table comprising:

a substantially rectangular, substantially horizontally disposed, top surface, with four legs extending downwardly from the four corners of the table to support the top surface;

at least a pair of substantially planar sideboard members comprising substantially rectangular, broad, board-like members which are adapted to extend longitudinally upwardly from the top surface of said table, with each sideboard member further having an extension projecting from the bottom of the rectangular sideboard member, said extension being a substantially flat, elongate section whose width is less than the corresponding width of the rectangular sideboard member; and means for releasably securing the planar sideboard members to the table comprising four pair of band-like attachment members, one pair of attachment members being located at each of the respective corners of the worktable, each pair of attachment members including an upper bracket and a lower bracket, with the upper brackets being attached to a mutually respective side of the table adjacent to the top surface and with the lower brackets being attached to a mutually corresponding leg of the table and being spaced from the upper brackets a distance less than the longitudinal length of the flat elongate extensions which project from the bottom sides of the rectangular sideboard members, said upper brackets comprising elongate, rigid bands which are spaced from respective sides of the table, said elongate rigid bands having inwardly projecting leg members at the opposite ends thereof, with means being provided for attaching the inwardly projecting leg members at the opposite ends thereof, with means being provided for attaching the inwardly projecting ends of the respective leg members of said upper brackets to the respective sides of said table to form respective, elongate spaces between the upper brackets and the respective sides of the table, wherein each of said elongate spaces is adapted to receive in snug, sliding engagement therewith the bottom of a respective rectangular sideboard member, said lower brackets comprising elongate, rigid straps which are spaced, respectively, from the sides of the legs of the table, said elongate, rigid strips having inwardly projecting leg members at the opposite ends thereof, with means being provided for attaching the inwardly projecting ends of the respective leg members of said lower brackets to the respective sides of the legs of the table to form respective elongate openings between the lower brackets and the respective sides of the legs of the table, wherein each of said elongate openings is adapted to receive in snug, sliding engagement therewith the free end portion of a flat, elongate extension of a respective planar sideboard member.

2. A worktable in accordance with claim 1, wherein means are provided for frictionally engaging the planar sideboard members within their respective attachment members, said means for engaging the sideboard members comprising providing a slight taper to the bottom sides of the rectangular sideboard members such that when the sideboard members are in their positions engaging said attachment members so as to extend upwardly from the sides of the table, the tapered portion of the rectangular sideboard members make secure frictional engagement with the upper bracket.

3. A worktable in accordance with claim 2, wherein the means for frictionally engaging the planar sideboard members further comprises providing a slight taper to the sides of the flat, elongate extensions of the planar wing members such that when the planar sideboard members are in their position engaging said attachment members so as to extend upwardly from the sides of the table, the tapered portion of the flat, elongate extensions make secure, frictional engagement with the lower bracket.

4. A worktable in accordance with claim 1, wherein means are provided for frictionally engaging the planar sideboard members within their respective attachment members, said means comprising providing a slight taper to the sides of the flat, elongate extension of the planar sideboard members such that when the planar sideboard members are in their position engaging said attachment means so as to extend upwardly from the sides of the table, the tapered portion of the flat, elongate extensions make secure, frictional engagement with the lower bracket member.

5. A worktable in accordance with claim 1, wherein casters are provided at the lower ends of the legs of the table, and hand grips are provided at the end side faces of the table adjacent to the top surface for moving the table.

6. A worktable in accordance with claim 1, wherein a system for dispensing elongate strips of masking paper having masking tape applied at along a longitudinal edge thereof is provided, said system for dispensing the strips of masking paper being positioned beneath the top surface of said table and at one of the longitudinal ends of said table.

7. A worktable in accordance with claim 1, wherein a system for dispensing sanding disks is provided, said system for dispensing the sanding discs being positioned beneath the top surface of said table and at one of the longitudinal ends of said table.

8. A worktable in accordance with claim 1, wherein a longitudinal depression is provided in the top surface of the table for receiving tools.

9. A worktable in accordance with claim 1, wherein there is further provided a pair of cushion bolsters which are adapted to be placed on the top surface and are further adapted to have supported thereon automobile glass pieces, bumpers and other items which must be protected from being scratched.

10. A worktable in accordance with claim 9, wherein the cushion bolsters comprise generally cylindrically shaped blocks of wood which have had a chord along the length thereof removed to produce a longitudinal flat surface along the length of the block, and a cushion material applied to the cylindrical surface of the block.

* * * * *